United States Patent [19]

Evans

[11] 4,272,022

[45] Jun. 9, 1981

[54] SHOWERHEAD WITH REPLACEABLE HOUSING

[75] Inventor: Frank C. Evans, Rockford, Mich.

[73] Assignee: Zin-Plas Corporation, Grand Rapids, Mich.

[21] Appl. No.: 85,524

[22] Filed: Oct. 17, 1979

[51] Int. Cl.[3] ..... B05B 1/18

[52] U.S. Cl. ..... 239/107; 239/288.5; 239/460; 239/553.3; 239/600

[58] Field of Search ..... 239/106, 107, 108, 109, 239/288.5, 460, 553.3, 553.5, 590, 590.3, 600

[56] References Cited

U.S. PATENT DOCUMENTS

| | | | |
|---|---|---|---|
| 2,890,835 | 6/1959 | Filliung | 239/109 |
| 2,990,123 | 6/1961 | Hyde | 239/107 |
| 3,254,842 | 6/1966 | Bachli et al. | 239/107 |
| 3,276,699 | 10/1966 | Graveley | 239/579 |
| 3,550,857 | 12/1970 | Ahlberg | 239/288 |
| 3,612,409 | 10/1971 | Henning | 239/602 |
| 3,831,860 | 8/1974 | Gullaksen et al. | 239/590.3 |
| 4,013,230 | 3/1977 | Gondek | 239/590.3 |
| 4,082,225 | 4/1978 | Haynes | 239/590.3 |

FOREIGN PATENT DOCUMENTS

| | | | |
|---|---|---|---|
| 454690 | 2/1949 | Canada | 239/107 |

*Primary Examiner*—Andres Kashnikow

*Attorney, Agent, or Firm*—John E. McGarry; Richard A. Gaffin

[57] ABSTRACT

A showerhead which provides for a reduced flow volume through the showerhead includes a replaceable decorative cover. The showerhead has a skirt housing (24) which is swivelably mounted on a ball joint (10) connected to a water supply pipe. A generally cylindrical spray director (32) is welded to the skirt member (24) to provide a spray pattern emitting from the showerhead. An orifice plate (44) which reduces the flow volume and a face plate (50) which defines a spray pattern are disposed within the spray director (32) downstream of the ball joint (10). The face plate (50) is axially adjustable in order to vary the spray pattern as well as provide for a self-flushing showerhead. The decorative cover includes an annular shell (58) coaxially disposed about the spray director (32) and an end plate (64) which is snap-fit into the outlet of the spray director. In this way, decorative covers of different styles can be used with the same functional assemblies.

15 Claims, 4 Drawing Figures

SHOWERHEAD WITH REPLACEABLE HOUSING

BACKGROUND OF THE INVENTION

1. Field of the Invention

The invention relates to low-flow showerheads having removable decorative covers which are snap-fit into place.

2. State of the Prior Art

Showerheads typically divide a stream of water into a series of jet sprays which are useful in bathing. It is often desirable to provide a showerhead having a restricted flow in order to conserve water while providing a spray pattern which is adequate for bathing. In such showerheads the flow of water is restricted by an orifice or a perforate disk disposed within the showerhead. In U.S. Pat. No. 3,831,860, issued Aug. 27, 1974, a low-flow volume showerhead is disclosed wherein an orifice extends across the water flow passage to restrict the flow of water discharging from a supply. The orifice is positioned upstream of a perforate disk plate which provides a spray pattern exiting the showerhead. Water discharging from the perforate plate is guided by a casing threaded onto a socket in which the orifice is disposed. In U.S. Pat. No. 4,013,230, issued May 22, 1977, a showerhead having a perforate plate which restricts the flow volume of water while providing a spray pattern is disclosed. The perforate plate is provided with a plurality of apertures which direct the spray of water against the inner surface of a skirt which is threadably connected to a valve body.

A showerhead including a face plate which is axially displaceable to provide for cleaning of grooves in the plate is disclosed in U.S. Pat. No. 3,254,842, issued June 7, 1966. The face plate includes a disc having a plurality of apertures which define a spray pattern and the axial adjustment allows the plate to be extended to the periphery of the showerhead to provide for cleaning of the spray-defining grooves. A decorative shell is disposed about the body of the showerhead and retained in place by an inwardly-extending flange which is seated between two threadably-mated housing portions.

In the foregoing patents, the body of the showerhead which is decorative in nature, is secured to the valve portion of the showerhead in a relatively fixed manner. In order to change the decorative body it is necessary to partially disassemble the showerhead by unscrewing the body from the valve portion. Since the showerhead has certain aesthetic features when viewed, it is desirable to provide a decorative shell which is easily replaced. In this way, showerheads having different appearances may be readily interchanged with a basic showerhead assembly.

DESCRIPTION OF THE INVENTION

In accordance with the invention, a showerhead which limits flow therethrough includes a decorative shell which is readily replaceable. The showerhead includes a ball joint having an inlet end which is connected to a supply pipe and an outlet end which terminates a ball. A passage extends through the body member for providing fluid flow therethrough. A skirt mounted on the ball joint permits swiveling of the showerhead to direct the spray as desired. The skirt is coaxially disposed about the passage in the ball and includes a generally annular section which extends from the skirt for directing fluid flow. An orifice plate disposed in the annular section downstream of the ball restricts fluid flow from the showerhead in order to conserve water. A spray pattern is defined by a generally solid plate having a plurality of slots spaced about the circumference. Water passes between the wall of the annular section and the slots in a defined spray pattern with the plate being axially displaceable to adjust the spray pattern as well as providing access to the slots for cleaning. A generally annular decorative shell is disposed about the annular section and spaced therefrom. The shell seats against an end plate which is detachably secured to the skirt. The end plate includes a raised bead on an inner circumference which is received by a groove on the skirt member in a snap-fit locking relationship to retain the plate on the showerhead. In this way the shell and the end plate are easily removed from the showerhead if it is desired to replace them with another type decorative shell. The easy removal and replacement of the showerhead permits the use of decorative covers which differ in appearance on a single showerhead assembly.

The annular section is typically secured to the skirt member by an ultrasonic weld. In this way the need for threadably securing the two sections, as is known in the prior art, is eliminated. The end plate and the shell have an aesthetically pleasing configuration and desirably are made of transparent acrylic so that decorative facets on the inner surfaces of the shell and plate may be seen. Alternately, the shell and end plate can be chrome plated.

BRIEF DESCRIPTION OF THE DRAWING

The invention will be described with reference to the accompanying drawings wherein like members bear like reference numerals in which.

BEST MODE FOR CARRYING OUT THE INVENTION

Figure 1:
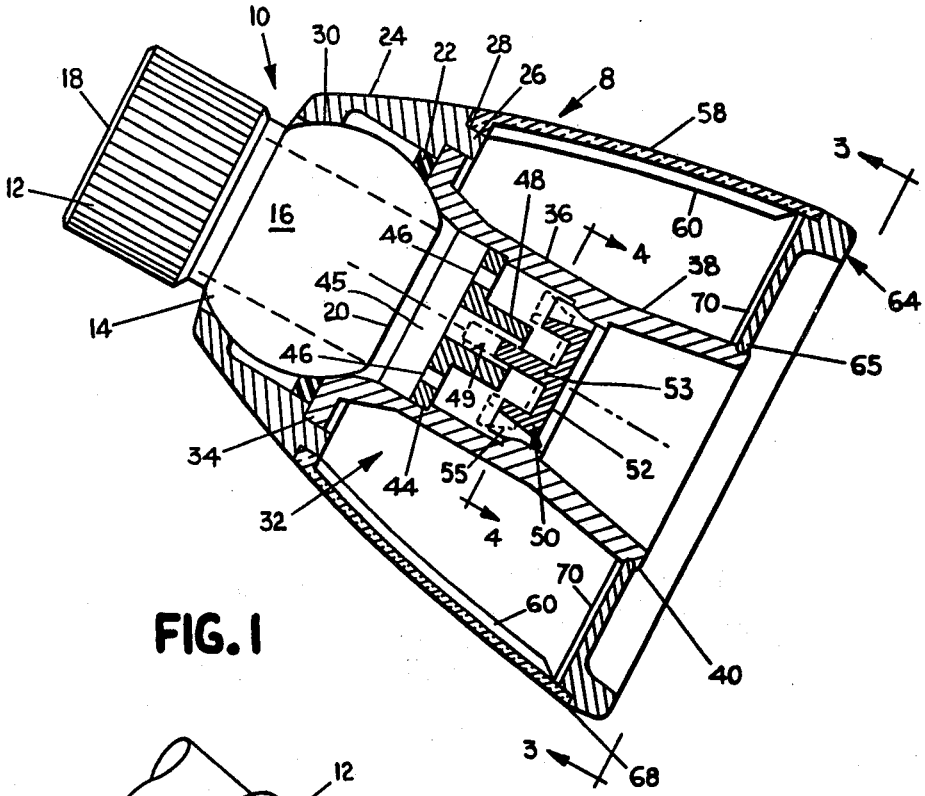
FIG. 1 is a cross-sectional view of a showerhead in accordance with the invention.
Figure 2:
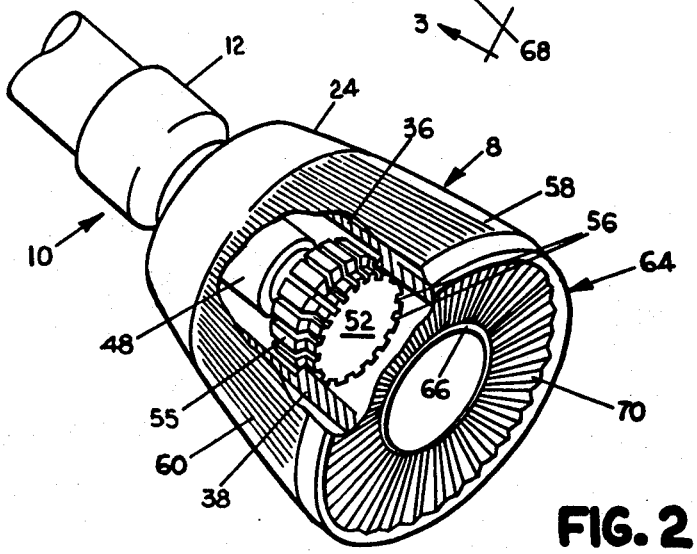
FIG. 2 is a perspective view of the showerhead with a section cutaway to show the interior.
Figure 3:
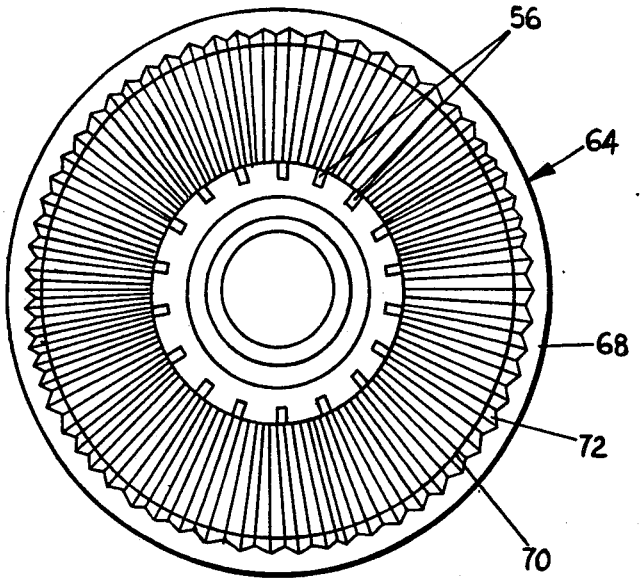
FIG. 3 is an end view taken along lines 3—3 of FIG. 1.
Figure 4:
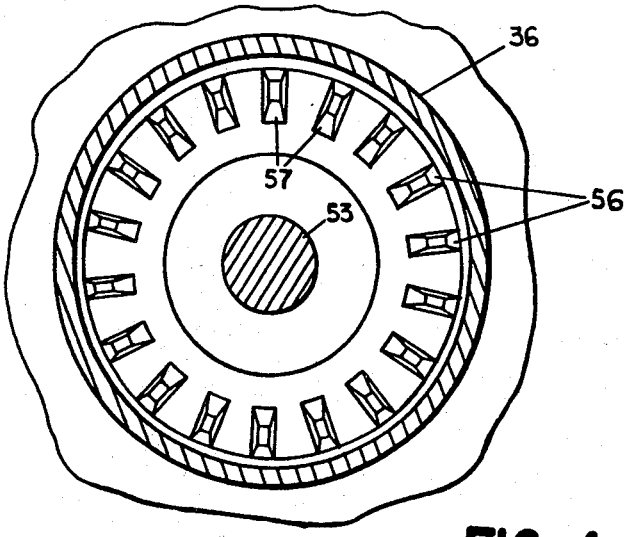
FIG. 4 is a cross-sectional view taken along lines 4—4 of FIG. 1.

With reference to FIGS. 1 and 2, a showerhead including a body 8 and a ball joint 10 is shown. The ball joint 10 includes a threaded portion 12 which extends beyond the body 8 and is adapted to be secured to a water supply pipe, for example. A ball 14 formed on an opposite end of the ball joint 10 is seated within the body 8. A passage 16 having an inlet 18 at the threaded portion of the ball joint and an outlet 20 in the ball 14 communicates a water supply with the interior of the showerhead body 8. An O-ring 22 is positioned between the ball 14 and a portion of the body 8 to provide a seal.

The body 8 includes a skirt member 24 which is swivelably mounted on the ball 14. The skirt member 24 is coaxially disposed about the ball 14 and includes a shoulder 30 which abuts an upper surface of the ball. The aforementioned O-ring 22 is seated between the ball 14 and a lower portion of the skirt member 24 to provide a sealing relationship. The downstream portion of the skirt member 24 includes a depending shoulder 26 which defines a groove 28 on an outer circumferential surface.

The inner annular surface of the shoulder 26 receives a spray director 32 having a flange 34 which seats against the shoulder 26. The flange 34 is typically secured to the shoulder 26 by ultrasonic welding. The spray director 32 includes a converging section 36 directly downstream of the outlet 20 in the ball and a diverging section 38 at an outlet section of the showerhead. The extreme end of the diverging section 38 includes a groove 40 formed on an outer annular surface thereof.

A restrictor plate 44 is press-fit within the converging section 36 of the spray diverter 32. The restrictor plate 44 is provided downstream of the ball 14 and serves to reduce the volume of water flowing through the showerhead by increasing the pressure within a chamber 45 defined between the ball 14 and the restrictor plate 44. The plate 44 includes a plurality of annularly arranged passages 46 for limiting flow therethrough. A cylindrical flange 48 extending downstream in the spray director 32 includes a bore 49 in which a face plate 50 is slidably mounted. The face plate 50 includes a generally solid plate member 52 from which a pin 53 extends upstream and is received within the bore 49 on the restrictor plate 44. In this way the face plate is axially movable to provide a self-cleaning showerhead. The plate 52 includes a raised shoulder 55 about the periphery thereof in which a plurality of circumferentially-spaced slots 56 are provided. The slots 56 have beveled surfaces 57 which converge towards the inner wall of the spray director 32. The slots 56 define a flow path between the periphery of the plate 52 and the inner wall of the spray director 32 through which water flows in a desired spray pattern.

A decorative cover 58 is coaxially disposed about the spray director 32 to provide an attractive showerhead. The cover 58 is generally cylindrical in shape and includes a plurality of axially extending facets 60 formed on the inner surface thereof. The facets provide an aesthetically pleasing configuration and are visible if the decorative cover is made of a transparent acrylic material, for example.

An end plate 64 is provided at the discharge end of the showerhead. The end plate 64 is an annular disc having a bead 65 carried on an inner annular surface 66 which is received in snap fit fashion in the groove 40 at the outlet end of the spray director 32. The outer circumference of the end plate 64 has a shoulder 68 against which the end portion of the cover 58 is seated. In this way, the cover 58 is retained in place about the spray director 32. The plate 64 may also be provided with a plurality of spaced facets 70 to provide an aesthetically pleasing configuration.

In a second embodiment, the end plate 64 and the cover 58 may form a one piece assembly which is snap-fit onto the spray director 32 in the same fashion as described above. Both embodiments allow for easy changing of the decorative cover in order to provide different appearing showerheads.

The showerhead provides for a controlled flow volume since the restrictor plate 44 disposed in spray director 32 restricts the passage of water from the ball to the showerhead outlet. As shown in FIG. 1, the apertures 46 in the restrictor plate 44 are spaced about the central bore 49 so that the water flows between the bore and the inner surface of the spray director 32. Since the outlet area of the apertures 46 is less than the area of the passage 16 in the ball through which water flows to the restrictor plate 44, the flow volume of water through the showerhead will be restricted.

In operation, water flows from a supply pipe through the passage 16 in the ball to the restrictor plate 44 where it passes through the apertures 46 in a reduced flow volume. After passing through the apertures 46, the flowing water passes to the face plate 50 where it flows in discrete streams in the slots 56 on the face plate. In this way, the pattern of water emitting from the showerhead is formed as a plurality of discrete streams which emerge from the showerhead and are directed by the diverging portion of the spray director 32. The peripheral edge of the face plate 50 is disposed adjacent to the inner surface of the spray director 32 to prevent flow between the inner surface and the edge of the face plate. Accordingly, water emerging from the showerhead is forced to flow in the slots defined in the face plate in a plurality of discrete streams. In this way, a concentrated spray stream is provided. The face plate 50 is slidably mounted by the pin 53 which is received within the bore 49 on the restrictor plate 44 so that the plate 50 is axially movable to provide for self-flushing of the slots 56 in a known manner.

Assembly of the cover is easily accomplished by providing a decorative cover which is snap-fit into place on the showerhead. Since it is often desirable to match the showerhead to a certain decorative motif, the flexibility offered by having a readily interchangeable decorative cover allows one to select a host of different shower heads with the same functional framework. In contrast to the prior-known showerhead constructions, the decorative cover is installed by sliding the cover into place and then snapping the end plate into place on the outlet of the spray director. The snap-fit locking arrangement for the decorative cover provides a relatively simply installed cover which avoids threaded connections.

In order to remove the cover from the showerhead, it is only necessary to urge the bead on the end plate from the groove at the end of the spray director. Replacement of the decorative cover is accomplished by sliding a new cover into place and then snapping the end plate onto the spray director. If a one-piece cover is used, then the entire cover including the integral end plate is slid onto the functional showerhead assembly and then snapped into place on the spray director.

The visual aspects of the covers may be selected to provide a variety of configurations. Since the cover can be formed from a transparent acrylic, a cover may be provided so the facets on the interior surface of the cover can be visible. Different color combinations of the shell and the end plate may also be provided. The cover may be chrome plated, for example, thereby providing another cover configuration.

The foregoing specification and drawings are merely illustrative of the invention and are not intended to limit the invention to the disclosed embodiment. Variations and changes which are obvious to one skilled in the art are intended to be within the scope and nature of the invention which is defined in the appended claims.

The embodiments of the invention in which an exclusive property or privilege is claimed are defined as follows:

1. A showerhead comprising:

a ball joint having an inlet end adapted to be connected to a supply pipe, an outlet end including a ball and a passage connecting said inlet end with said outlet end to provide for fluid communication through said ball joint;

a skirt member mounted on said ball for swiveling movement thereon and coaxially disposed about said passage, said skirt member including a shoulder about a lower outer circumference;

a generally cylindrical water flow section extending from said skirt member for directing fluid flowing through said passage;

an annular groove disposed on an outer circumferential surface of said cylindrical section;

orifice plate means disposed in said cylindrical section downstream of said ball for shaping fluid flowing through said cylindrical section into a water spray pattern; and a generally cylindrical decorative shell coaxially disposed about and radially spaced from said cylindrical water flow section including an annular end portion having a bead on an inner circumference thereof received in a snap-fit locking relationship in said groove;

said shell removably abutting said shoulder of said skirt member and having an outer surface continuous with an outer surface of said skirt member;

wherein said shell is removable from said cylindrical water flow section without disconnecting said ball joint from said supply pipe.

2. The showerhead of claim 1 wherein said orifice plate means includes a perforate plate member for restricting flow through said cylindrical water flow section and a substantially solid plate member including means for permitting fluid flow past said plate member so as to direct fluid flow along said cylindrical section.

3. The showerhead of claim 2 wherein said perforate plate member is fixed upstream from said substantially solid plate member.

4. The showerhead of claim 3 wherein said substantially solid plate member is axially displaceable along said cylindrical water flow section.

5. The showerhead of claim 4 wherein said substantially solid plate member includes a pin which extends upstream in said water flow section and said perforate plate includes a central bore in which said pin is slidably received, thereby permitting axial movement of said plate member to facilitate cleaning of said showerhead, said plate member being retained in said cylindrical water flow section by an abutment surface provided therein.

6. The showerhead of claim 2 wherein said means for permitting fluid flow past said substantially solid plate member includes a plurality of slots spaced about the circumference of the plate for defining a spray pattern.

7. The showerhead of claim 6 wherein the circumferential edge of said substantially solid plate member is in sliding contact with an inner surface of said cylindrical water flow section.

8. The showerhead of claim 7 wherein said plurality of slots have an angled surface.

9. The showerhead of claim 8 wherein said angled surface defines an acute angle relative to the portion of the inner wall of the water flow section adjacent said plate member.

10. The showerhead of claim 1 wherein said cylindrical water flow section includes a converging portion in which said orifice plate means is disposed and a diverging portion downstream of said plate means.

11. The showerhead of claim 10 wherein said cylindrical water flow section is a separate member attached to an outlet end of said skirt member.

12. The showerhead of claim 11 wherein said cylindrical water flow section is attached to the skirt member by an ultrasonic weld.

13. The showerhead of claim 1 wherein said cylindrical decorative shell is provided with a plurality of facets spaced about an inner surface thereof and said cylindrical shell is transparent to thereby expose the facets to view.

14. The showerhead of claim 1 wherein said cylindrical decorative shell comprises a generally cylindrical body and a separate end plate having a shoulder in abutment with an end surface of said cylindrical body for retaining said body on the showerhead, said bead being disposed on said end plate.

15. The showerhead of claim 14 wherein said cylindrical body and said end plate are provided with a plurality of facets about an inner surface thereof and said cylindrical body and said end plate are transparent to thereby expose the facets to view.

* * * * *